US006109457A

United States Patent [19]

Dahnke

[11] Patent Number: 6,109,457

[45] Date of Patent: Aug. 29, 2000

[54] CLOTHES HANGER STORAGE DEVICE

[76] Inventor: David Dahnke, 317 E. X St., Deer Park, Tex. 77536

[21] Appl. No.: 09/358,967

[22] Filed: Jul. 22, 1999

[51] Int. Cl.[7] ..... A47F 7/00

[52] U.S. Cl. ..... 211/49.1; 211/32

[58] Field of Search ..... 211/49.1, 119.004, 211/113, 118, 30, 32, 33, 72; 206/300; 248/176.1; 223/85; D3/304

[56] References Cited

U.S. PATENT DOCUMENTS

| | | | |
|---|---|---|---|
| 2,530,609 | 11/1950 | Friedman | 248/176.1 |
| 2,609,919 | 9/1952 | Lee | 206/300 |
| 2,853,196 | 9/1958 | Drame | 248/176.1 |
| 3,115,968 | 12/1963 | Peterson | 211/72 |
| 3,127,018 | 3/1964 | McMasters | 206/300 |
| 3,139,986 | 7/1964 | Strock | 206/300 |
| 3,490,599 | 1/1970 | Von Maur, Jr. | 211/49.1 |
| 3,661,268 | 5/1972 | Boley | 211/49.1 |
| 3,737,081 | 6/1973 | James | 223/85 |
| 3,994,460 | 11/1976 | Geiger | 248/176.1 |
| 4,016,981 | 4/1977 | Hildt | 211/49.1 |
| 4,722,438 | 2/1988 | Hicks | 206/300 |
| 4,768,658 | 9/1988 | Shafto | 211/49.1 |
| 4,993,557 | 2/1991 | Davis | 211/30 |
| 5,083,690 | 1/1992 | Winskas | 223/85 |
| 5,169,104 | 12/1992 | Kwoh | 248/176.1 |
| 5,188,241 | 2/1993 | Kobza et al. | 211/59.1 |
| 5,303,829 | 4/1994 | Kennedy | 211/30 |
| 5,758,779 | 6/1998 | Atkins | 211/32 |
| 5,762,206 | 6/1998 | Leichter | 211/32 |
| 5,833,184 | 11/1998 | Scola | 248/176.1 |
| 5,894,940 | 4/1999 | Gusdorf et al. | 211/119.004 |

*Primary Examiner*—Daniel P. Stodola
*Assistant Examiner*—Jennifer E. Novosad
*Attorney, Agent, or Firm*—Russell J. Egan

[57] ABSTRACT

A device for storing clothes hangers in such fashion as to keep them out-of-the-way in an untangled condition so as to be readily available when needed. One embodiment allows the device to be suspended from either a wall mounted hook or pin and to also be portable via the built-in handle. Another embodiment allows the subject device to be hung over a door or partition. The hanger engaging portion is configured to accept hangers of several different styles.

2 Claims, 2 Drawing Sheets

CLOTHES HANGER STORAGE DEVICE

BACKGROUND OF THE INVENTION

1. The Field of the Invention

The present invention related to a device for storing clothes hangers in such fashion as to keep them out of the way during periods of non use and yet to still be readily available for use when needed.

2. The Prior Art

Everyone has the problem of what to do with clothes hangers when they are not in use. It seems that they have minds of their own in wishing to become entangled with nearby hangers so that often it is substantially impossible to retrieve but a single usable clothes hanger from a closet. Many comedians have made up entire monologs on the subject of clothes hangers and the problems associated with retrieving a single useable clothes hanger from a closet.

The prior art shows several different approaches to storing clothes hangers. Two commercial devices for receiving hangers are shown in U.S. Pat. No. 4,016,981 to Hildt and U.S. Pat. No. 4,768,658 to Shafto. Neither of these devices is particularly attractive so as to make them something one would want in their home and neither is readily portable.

U.S. Pat. No. 3,490,599 to Von Maur shows what appears to be a difficult device to use. It receives the curved hook portion of a clothes hanger in a slot for stacking. Thus the hook portion of the clothes hanger must be placed in the device with a fair degree of accuracy or it will not fit at all.

U.S. Pat. No. 5,833,184 to Scola shows a clothes hanger receiving device which is provided with a handle for portability. However, this device rests on the floor, as is the case for each of the above mentioned devices, and does not have means for mounting it on a wall in either a horizontal or vertical position.

U.S. Pat. No. 5,188,241 to Kobza et al show a clothes hanger receiving stand with several stages of brackets which can hold a plurality of clothes hangers in an inverted position.

SUMMARY OF THE INVENTION

The present invention provides a device for storing clothes hangers in such fashion as to keep them out-of-the-way, in an untangled condition, so as to be readily available when needed. One embodiment allows the device to be suspended from either a wall mounted hook or pin and to also be portable via the built-in handle. Another embodiment allows the subject device to be hung over a door or partition. The clothes hanger engaging portion is configured to accept clothes hangers of several different styles.

BRIEF DESCRIPTION OF THE DRAWINGS

The present invention will now be described, by way of example, with reference to the accompanying drawings, in which.

DETAILED DESCRIPTION OF THE PRESENT EMBODIMENT

Figure 1:
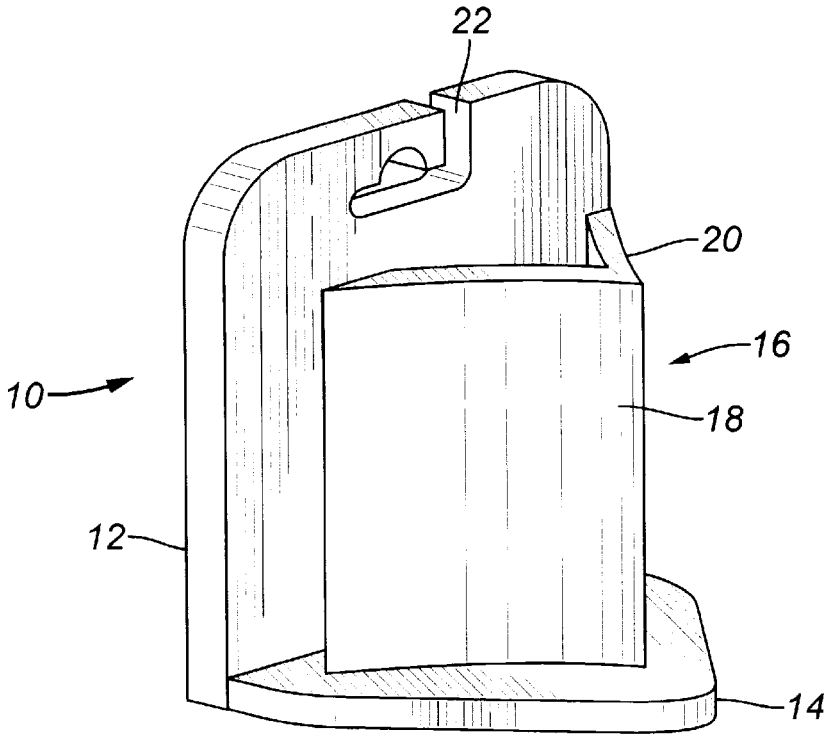
FIG. 1 is a perspective view of the present invention.

The subject clothes hanger storage device 10 has a back member 12, a base member 14 extending normal from the lower edge of the back member 12, and a hanger guide means 16 comprised by at least two wall members 18, 20 joined at their edges remote from the back member 12 and diverging toward the back member 12. Preferably the wall members 18, 20 are slightly concave (in horizontal section) to allow for free movement of clothes hangers (not shown) thereover and to accommodate different styles of clothes hangers.

Figure 2:
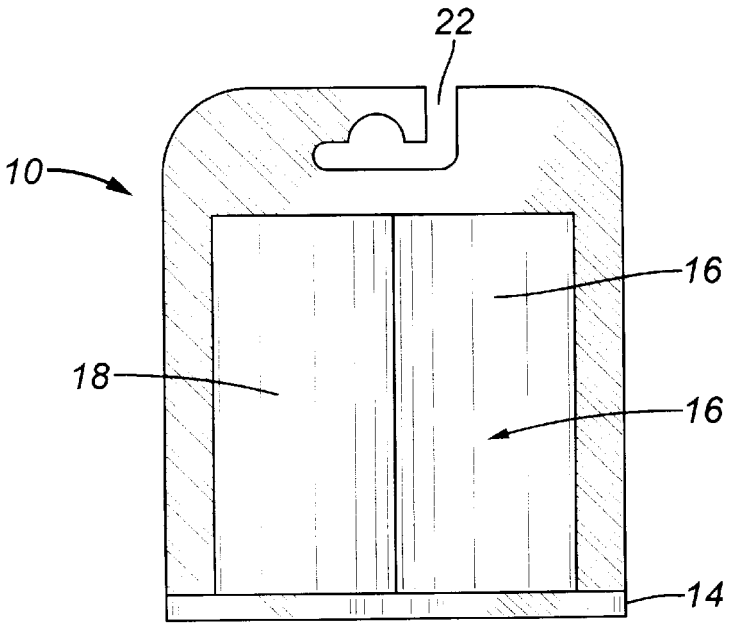
FIG. 2 is a front elevation of the present invention.
Figure 3:
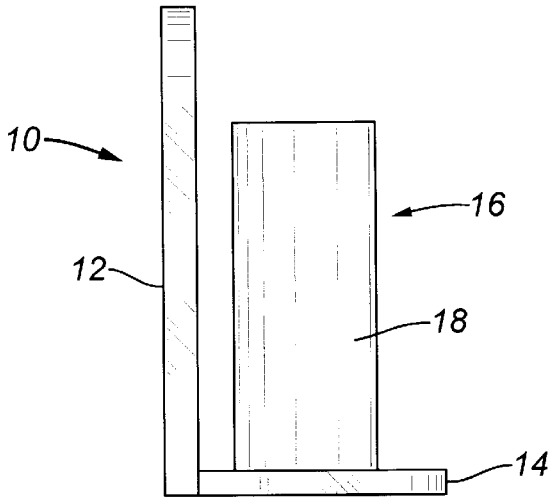
FIG. 3 is a left side elevation of the present invention.
Figure 4:
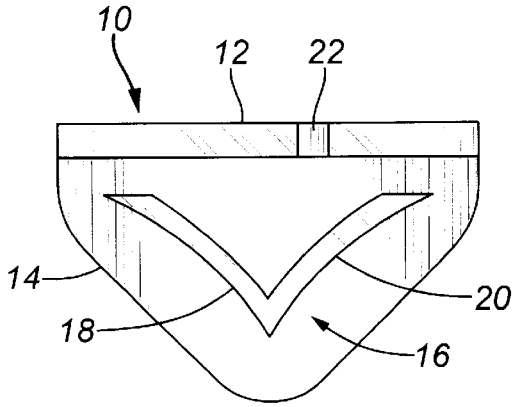
FIG. 4 is a top plan view of the present invention.

The back member 12 is shown in FIGS. 1 and 2 with a profiled opening 22 which allows the device to be either carried or suspended on a wall from a hook or a pin (neither of which has been shown). It should be noted that while the subject device is shown in a vertical condition, there is nothing to prevent it from being mounted horizontally and still receive clothes hangers thereon.

Figure 5:
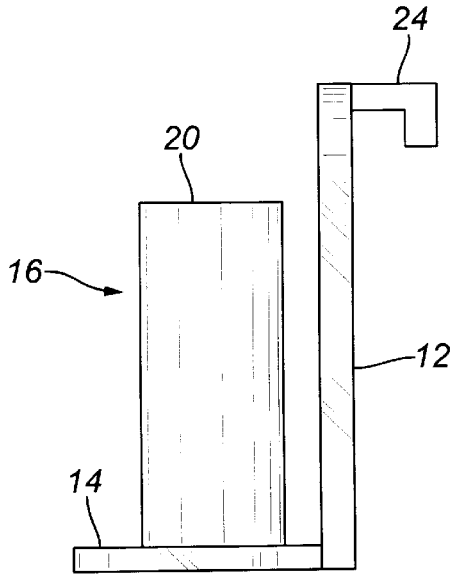
FIG. 5 is a right side elevation of an alternate embodiment of the present invention adapted to be hung over a door or partition.

FIG. 5 shows an alternate embodiment of the subject invention. Hanger means 24 extends rearwardly from the upper edge of the back member 12 and is profiled for suspending the device 10 over the top of a door or partition (neither of which is shown).

While the hanger guide means 16 has been shown as a pair of diverging walls, the guide means could have a third wall (not shown) joining the rear edges of the walls 18, 20.

The present invention could be made from a wide variety of materials to satisfy a variety of tastes. For example, it could be manufactured from wood with a rich wood grain appearance making the device an attractive accessory in a dressing room. It could be manufactured from plastics materials with any one of a variety of surface treatments to give either a wood grain appearance or a colorful appearance.

The present may be subject to many modifications and changes without departing from the spirit of essential characteristics of the present invention. Therefor the present specification should be considered in all respects as illustrative and not restrictive of the scope of the invention as defined by the appended claims.

I claim:

1. A device for storing clothes hangers in such fashion as to keep them out-of-the-way in an untangled condition so as to be readily available when needed, said device comprising:

a generally rectangular back member having upper and lower edges, said upper edge having therein a profiled opening allowing for both gripping of the device for carrying and for suspending the device on a vertical surface;

a base member joined to and extending normal from sid lower edge of said back member;

hanger guide means mounted on and extending normal to said base member spaced from said back member, said hanger guide means formed by a pair of generally rectangular wall members joined at their edges remote from said back member and diverging toward said back member, said wall members having a concave profile, in horizontal section, sufficient to allow a variety of clothes hanger shapes to be received thereon;

whereby hangers can be placed over the guide means and against the base member so as to be readily available.

2. The device according to claim 1 wherein:

said back member has at least one rearwardly projecting integral member having a downwardly projecting portion on the free end thereof enabling the device to be hung over a door or partition.

* * * * *